US012241213B2

(12) United States Patent
Impero

(10) Patent No.: US 12,241,213 B2
(45) Date of Patent: Mar. 4, 2025

(54) ROAD SAFETY BARRIER ASSEMBLY

(71) Applicant: Pasquale Impero, Acerra (IT)

(72) Inventor: Pasquale Impero, Acerra (IT)

(73) Assignee: Pasquale Impero (IT)

( * ) Notice: Subject to any disclaimer, the term of this patent is extended or adjusted under 35 U.S.C. 154(b) by 765 days.

(21) Appl. No.: 17/430,161

(22) PCT Filed: Feb. 20, 2020

(86) PCT No.: PCT/IB2020/051427
§ 371 (c)(1),
(2) Date: Aug. 11, 2021

(87) PCT Pub. No.: WO2020/170189
PCT Pub. Date: Aug. 27, 2020

(65) Prior Publication Data

US 2022/0154414 A1 May 19, 2022

(30) Foreign Application Priority Data

Feb. 21, 2019 (IT) ..... 102019000002495

(51) Int. Cl.
*E01F 15/04* (2006.01)
*E01F 9/20* (2016.01)
*E01F 9/669* (2016.01)

(52) U.S. Cl.
CPC ..... *E01F 15/0461* (2013.01); *E01F 9/20* (2016.02); *E01F 9/669* (2016.02)

(58) Field of Classification Search
CPC ..... E01F 15/0461; E01F 9/20; E01F 9/669
See application file for complete search history.

(56) References Cited

U.S. PATENT DOCUMENTS 6,456,198 B1 * 9/2002 Kato ..... G08B 13/122 256/48
8,776,465 B2 * 7/2014 Murphy ..... G08B 13/22 52/309.4
2002/0191391 A1 * 12/2002 Van Etten ..... F21V 1/16 362/267
2018/0286230 A1 * 10/2018 Hong ..... H02S 40/38
2022/0290387 A1 * 9/2022 Impero ..... F21V 23/0442

FOREIGN PATENT DOCUMENTS

JP S6341613 U 3/1988
JP H07133607 A 5/1995
KR 20160087506 A 7/2016

* cited by examiner

*Primary Examiner* — Abigail A Risic
(74) *Attorney, Agent, or Firm* — Endurance Law Group PLC

(57) ABSTRACT

A road safety barrier assembly has a plurality of elements for re-directing a vehicle which impacts against the road safety barrier, a plurality of supports supporting the re-directing elements, sensors and/or light signaling sources. At least some of the supports each comprise a cavity and are distributed along the road safety barrier. Electronic devices distributed along the road safety barrier are each connected to a sensor and/or to a light signaling source and housed in a cavity of a support. Electric cables extend along the road safety barrier and electrically connect each of the electronic devices. Each cavity of the supports is accessible from outside in order to enable replacement or repair of an electronic device housed internally thereof.

9 Claims, 7 Drawing Sheets

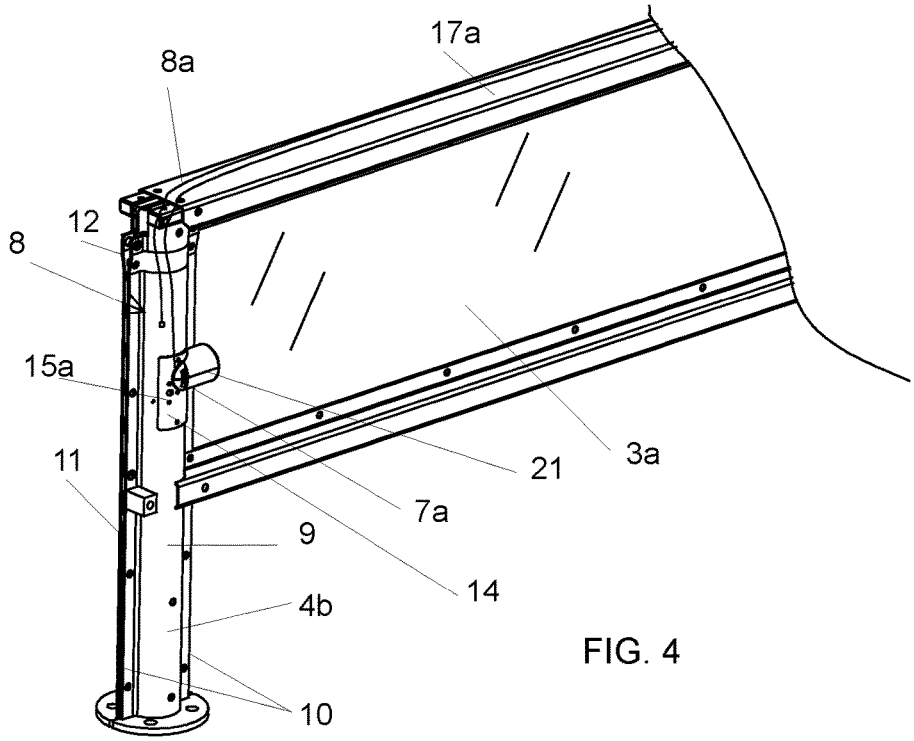
FIG. 4
FIG. 5
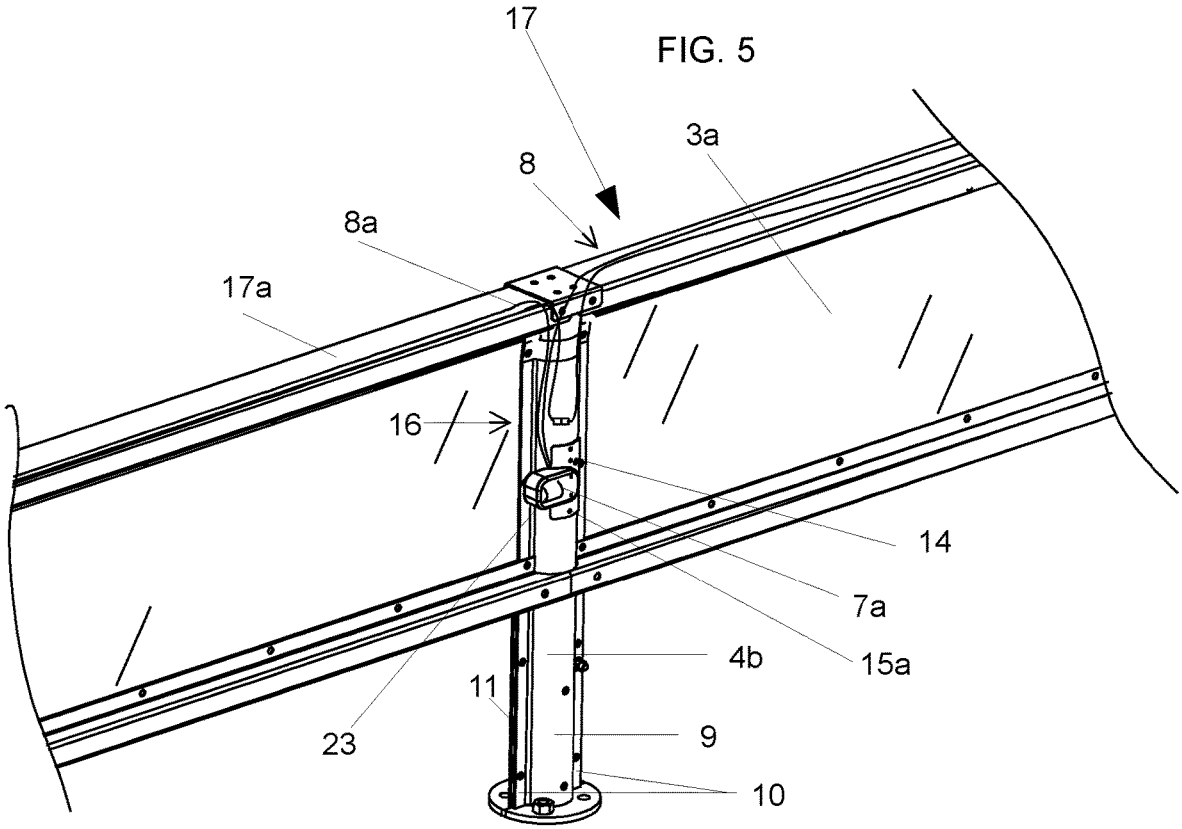

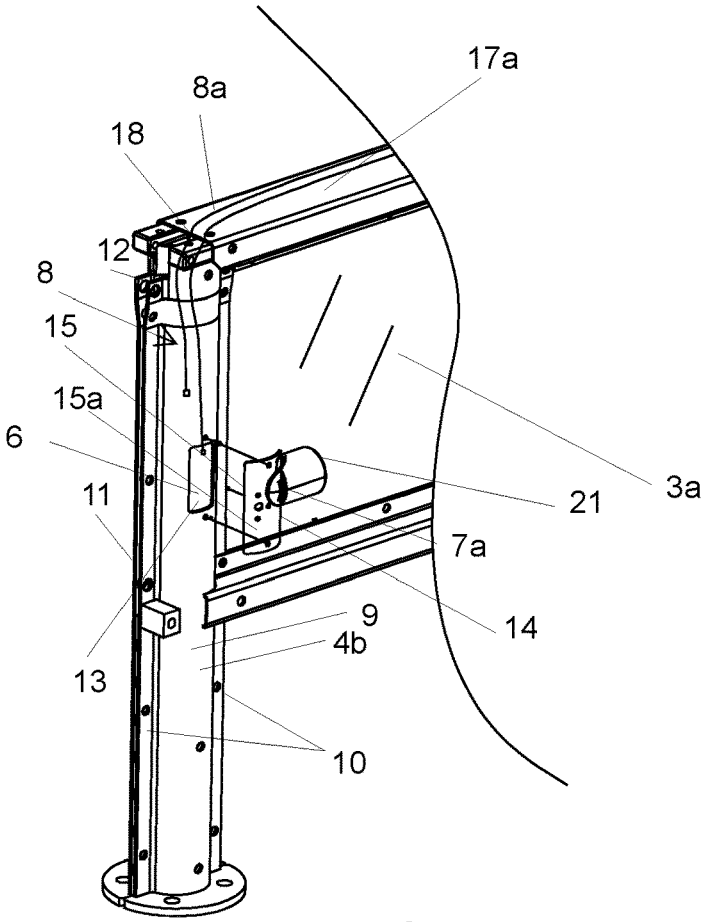
FIG. 6
FIG. 7
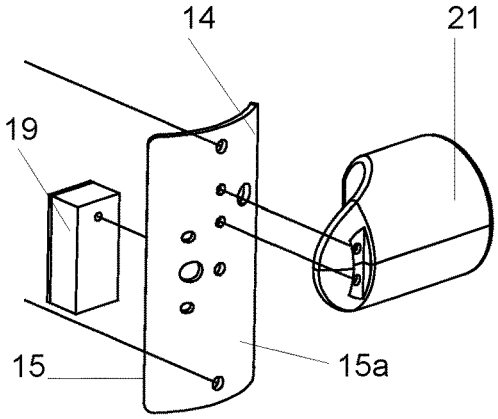
FIG. 8
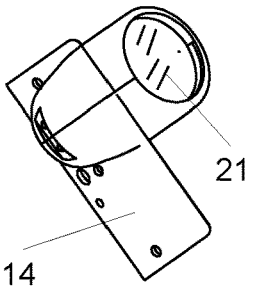
FIG. 9
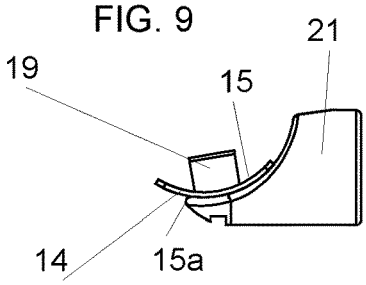

ROAD SAFETY BARRIER ASSEMBLY

FIELD OF THE INVENTION

The present invention relates to the technical sector concerning road safety barriers which extend along a side of a carriageway so as to redirect vehicles which, for unexpected causes, skid or swerve with respect to the correct travel trajectory. In particular the present invention relates to a road safety barrier assembly.

DESCRIPTION OF THE PRIOR ART

A road safety barrier, known as a "guard rail", which extends along a side of a carriageway and which, in turn, comprises: a plurality of re-directing elements for re-directing a vehicle which impacts against the road safety barrier; a plurality of support elements for supporting the plurality of re-directing elements.

In detail, each support element of the plurality of support elements is shaped as an upright which is planted in the ground, at a certain difference from one another, and the re-directing elements of the plurality of re-directing elements are shaped as undulating tapes that are fixed to the above-mentioned uprights in such a way as to be consecutive to one another. The undulating tapes are reciprocally fixed to one another so to form a continuous front.

In recent years the need has arisen to arrange sensors and/or light signalling sources on the road safety barriers, to perform various tasks.

For example, in some portions of carriageway, there might arise the need to have a luminous road signal on the road safety barrier to improve visibility. Or, in portions of carriageway in which an impact has just happened, of a vehicle against a road safety barrier, there might arise the need for immediate detection, using impact detecting sensors, of the impact that has taken place, so as to intervene for maintenance and restoration of the road safety barrier and in order to normalise traffic in the shortest possible time.

Alternatively when in a portion of carriageway there is slowed traffic or even jams, there might arise the need to arrange, on the road safety barrier, upstream of the above-mentioned carriageway, light signalling sources warning drivers to moderate their speed.

In the event of an impact of a vehicle against the road safety barrier, it might occur that one or more sensors and/or one or more light signalling sources, together with corresponding electronic devices connected to the sensors and/or to the light signalling sources, could be destroyed. This can also happen when care has been taken to arrange, where possible, sensors and/or light signalling sources and relative electronic devices in a position such as not to be directly impacted by a crashing vehicle, for example in a raised position and further back with respect to the carriageway, or fixed on the side of the road safety barrier which is opposite the side facing the carriageway.

The replacement of the sensors and/or the light sources, as well as the electronic devices connected thereto, has not insignificant costs and times.

SUMMARY OF THE INVENTION

The aim of the present invention consists in obviating this drawback.

The above aim is obtained by means of road safety barrier assembly according to claim 1.

Each electronic device of the plurality of electronic devices is housed in a cavity of a support element of the plurality of support elements: the support element thus excellently protects the electronic device should a vehicle impact against the road safety barrier.

BRIEF DESCRIPTION OF THE DRAWINGS

Specific embodiments of the invention will be described in the following part of the present description, according to what is recited in the claims and with the aid of the appended tables of drawings, in which:

FIGS. 4 and 5 are, respectively, views of detail W of FIG. 1 and detail Z of FIG. 1;

FIG. 6 is the same view as FIG. 4, in which some components are illustrated in exploded view;

FIGS. 7-9 are schematic views of some components that are visible in FIG. 6.

DESCRIPTION OF THE PREFERRED EMBODIMENTS

Figure 1:
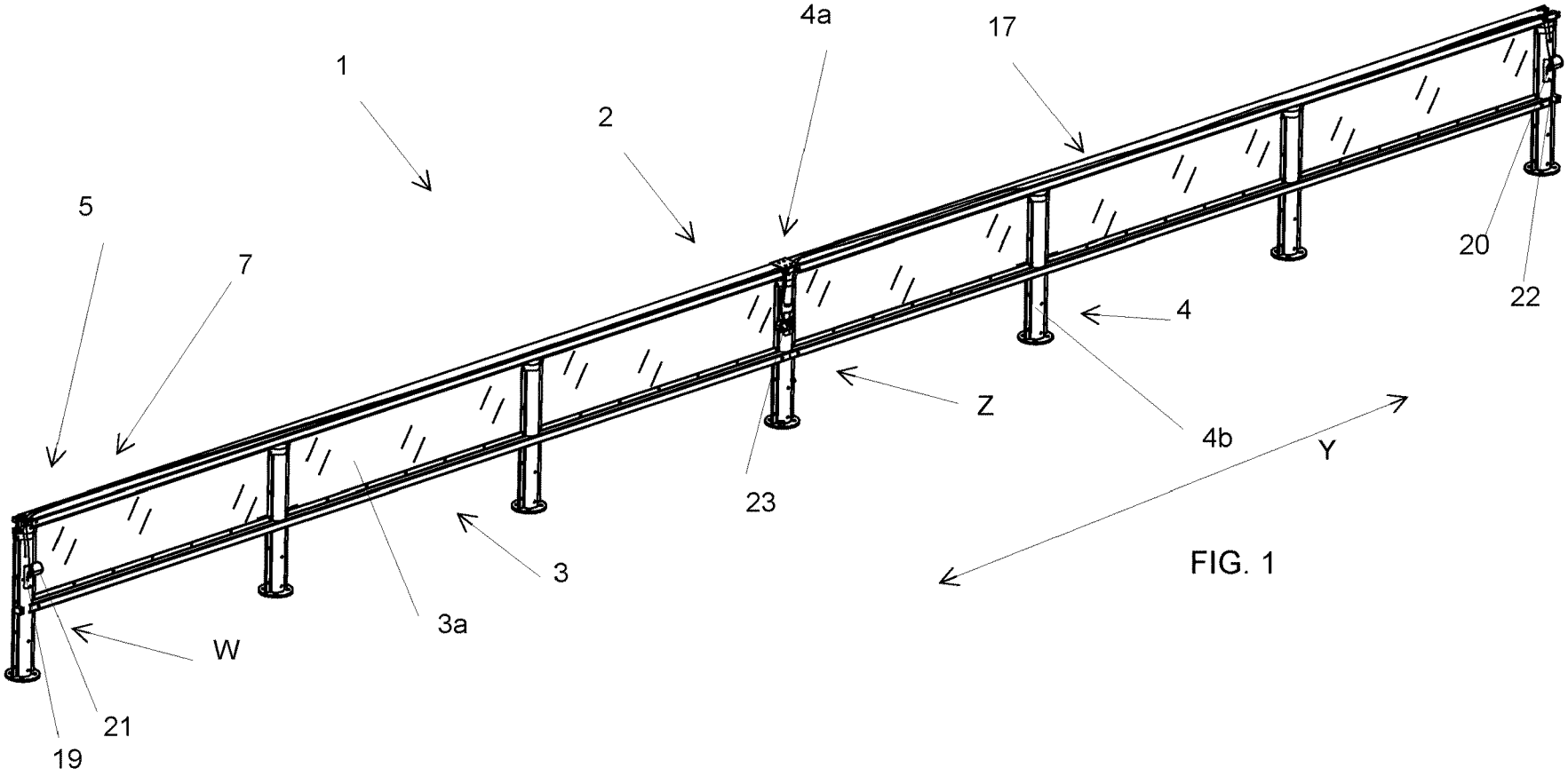
FIGS. 1-3 are schematic views respectively in perspective, lateral and top views of the road safety barrier assembly of the present invention, according to a first embodiment thereof.
Figure 2:
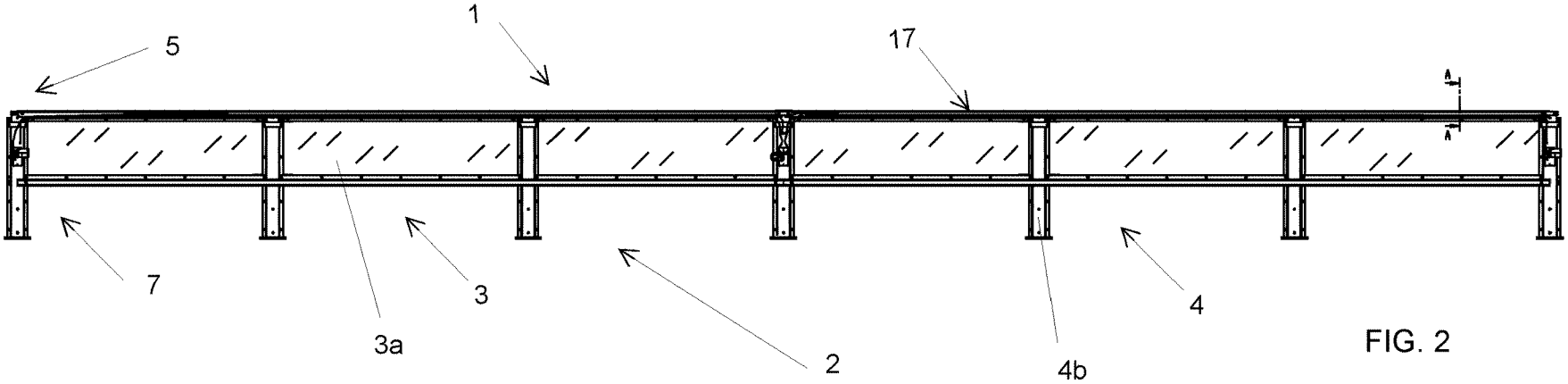

With reference to the appended tables of drawings, reference numeral (1) denotes a road safety barrier assembly, object of the present invention, comprising: a road safety barrier (2) which extends along a side of a carriageway, in turn comprising: a plurality of re-directing elements (3) for re-directing a vehicle which impacts against the road safety barrier (2); a plurality of support elements (4) for supporting the plurality of re-directing elements (3); a plurality of sensors and/or light signalling sources (5); at least a part of the support elements (4*a*) of the plurality of support elements (4) each comprises a cavity (6) and are distributed along the road safety barrier (2); a plurality of electronic devices (7) which are distributed along the road safety barrier (2), each of the electronic devices (7*a*) of the plurality of electronic devices (7) being connected to a sensor and/or to a light signalling source (5*a*) of the plurality of sensors and/or light signalling sources (5) and being housed in a cavity (6) of a support element (4*b*) of the plurality of support elements (4); a plurality of electric cables (8) which extend along the road safety barrier (2) and which electrically connect each electronic device (7*a*) of the plurality of electronic devices (7); where each cavity (6) of the support elements (4*b*) of the plurality of support elements (4) is accessible from outside in order to enable replacement or repair of an electronic device (7*a*) of the plurality of electronic devices (7) which is housed internally thereof (see FIGS. 1 and 2).

The plurality of electric cables (8) can extend along the road safety barrier (2). The electric cables (8*a*) of the plurality of electric cables (8) can follow the road safety barrier (2), for example being positioned alongside the barrier. Still more preferably, the electric cables (8*a*) of the plurality of electric cables (8) extend along the road safety barrier (2) in such a way as to be parallel to one another.

The electric cables (8*a*) of the plurality of electric cables (8) are preferably laid on the road safety barrier (2) in such a way as to be parallel to the extension direction (Y) of the road safety barrier (2) and are borne by the road safety barrier (2).

Figure 1A:
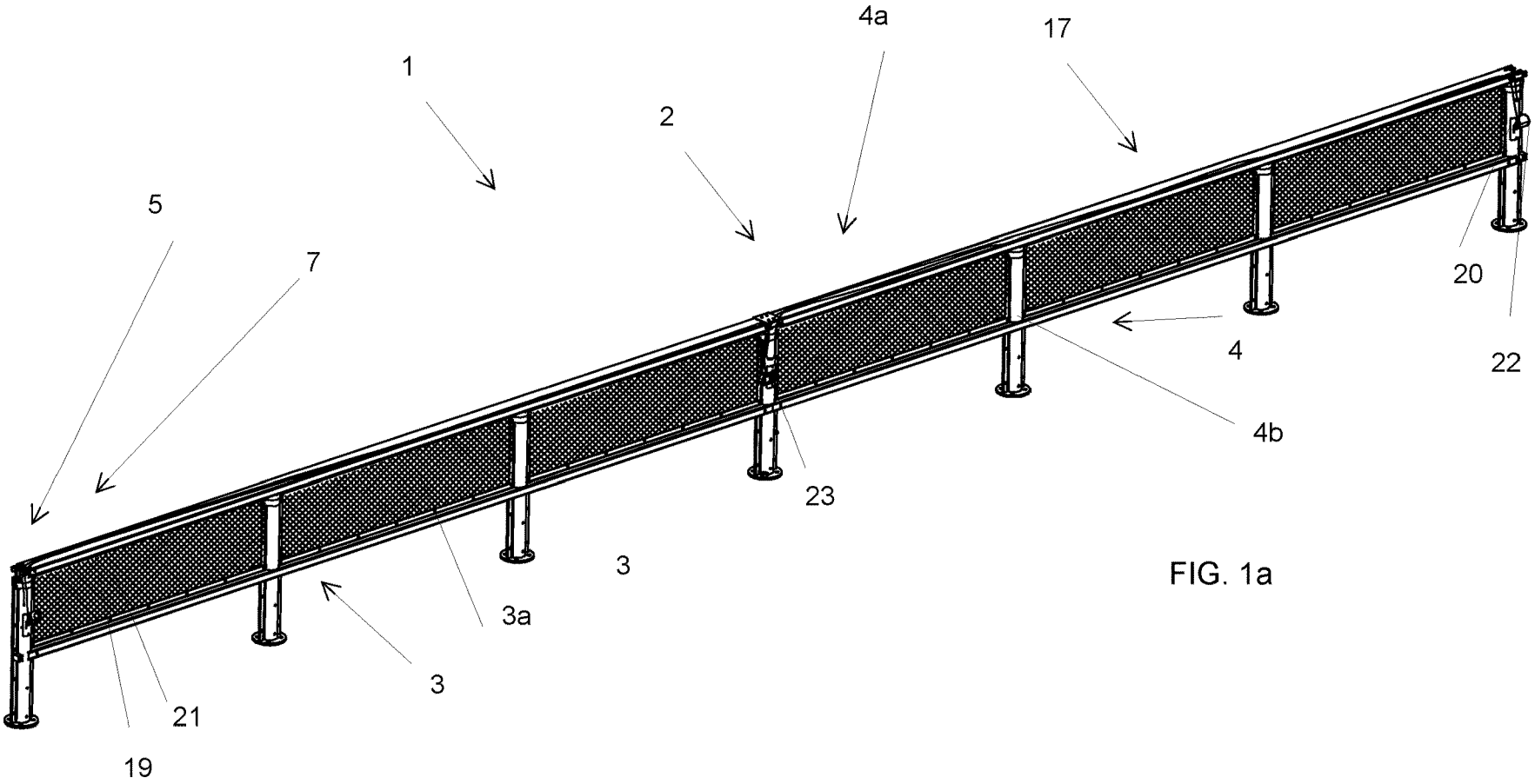
FIGS. 1*a*, 1*b* and 1*c* are schematic perspective views of the road safety barrier assembly of the present invention, according to three different embodiments thereof.
Figure 1B:
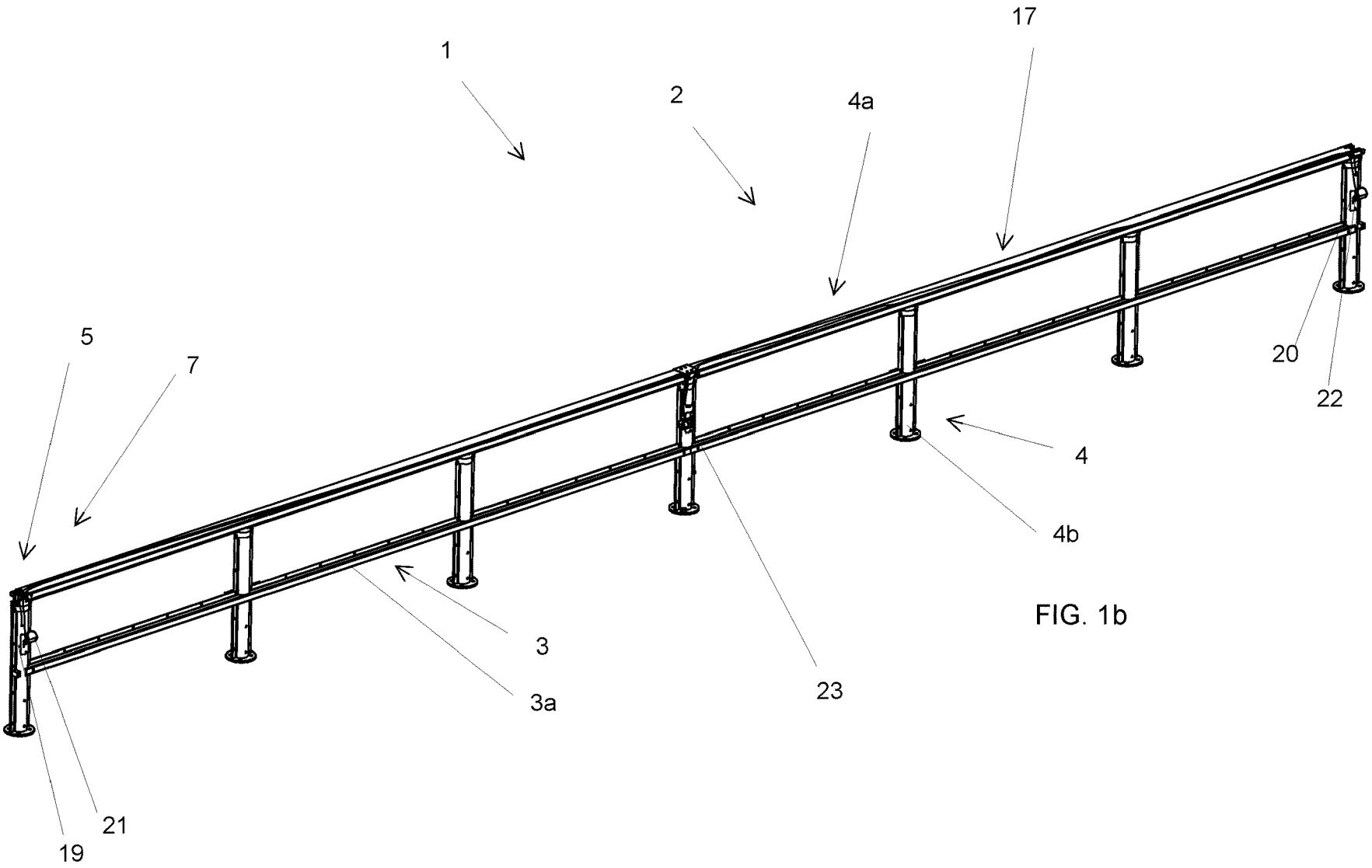
Figure 1C:
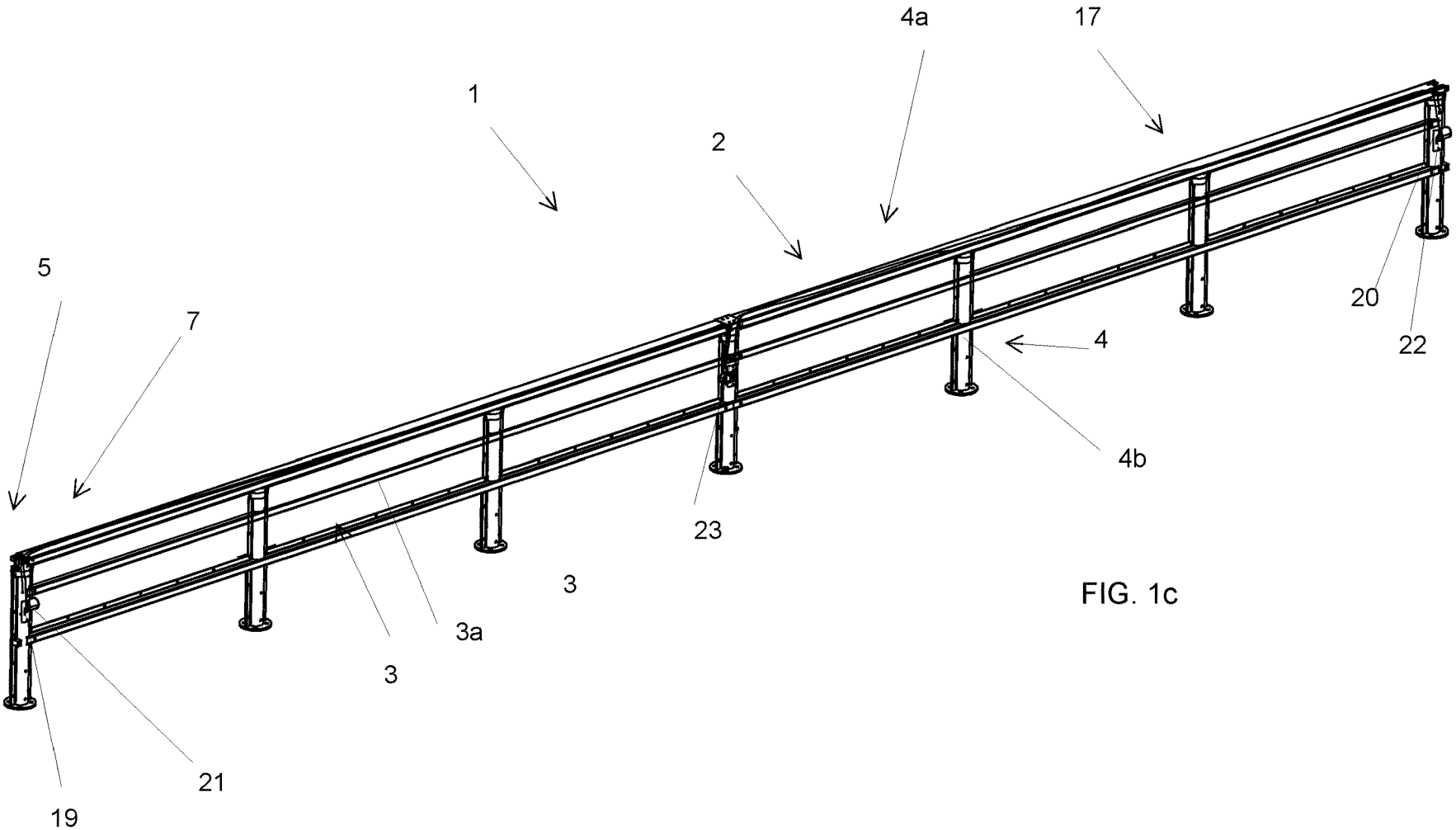
Figure 3:
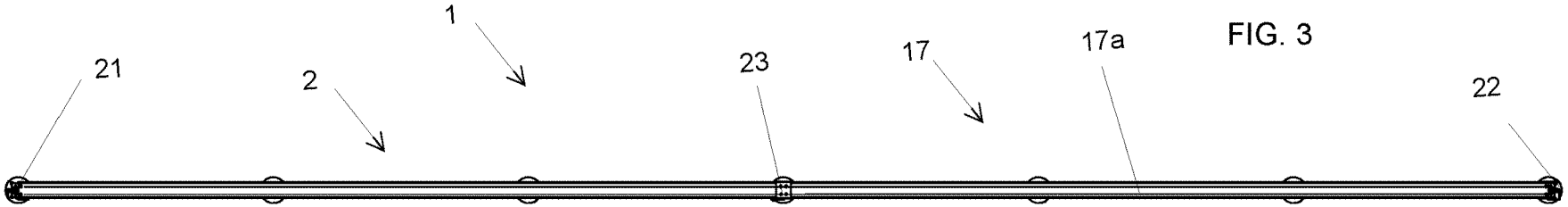

Each re-directing element (3*a*) of the plurality of re-directing elements (3) can be a steel panel or a plastic panel (see FIGS. 1-3). Alternatively, each re-directing element (3*a*) of the plurality of re-directing elements (3) can be a steel grid or metal longitudinal elements (see FIGS. 1*a*-1*c*).

Each support element (4*a*) of the plurality of support elements (4) can have a vertical extension axis and can rise from the road in an upwards direction.

Each support element (4*b*) of the plurality of support elements (4) can comprise: a first half-shell (9) comprising in turn a first pair of plates (10) projecting laterally, each plate of the first pair of plates (10) being arranged at a relative end of the first half-shell (9) and being opposite the other; a second half-shell (11) comprising in turn a second pair of plates (12) projecting laterally, each plate of the second pair of plates (12) being arranged at a relative end of the second half-shell (11) and being opposite the other. Each support element (4*b*) of the plurality of support elements (4) can be assembled, internally defining the relative cavity (6), by joining the first half-shell (9) and the second half-shell (11) at the first pair of plates (10) and the second pair of plates (12). The first pair of plates (10) and the second pair of plates (12) can be fixed to one another by means of screws and bolts.

Each re-directing element (3*a*) of the plurality of re-directing elements (3) can be borne by each support element (4*b*) of the plurality of support elements (4).

Each sensor and/or light signalling source (5*a*) of the plurality of sensors and/or light signalling sources (5) can be housed externally of the cavity (6) of a support element (4*b*) of the plurality of support elements (4).

Each sensor (5*a*) of the plurality of sensors (5) can be an impact detecting sensor and be able to detect the impact of a vehicle against the road safety barrier (2).

Or each sensor (5*a*) of the plurality of sensors (5) can be a slow traffic detection sensor.

The electronic devices (7*a*) of the plurality of electronic devices (7) can be arranged along the length of the road safety barrier (2) in such a way as to be distributed uniformly along the road safety barrier (2).

The electronic devices (7*a*) of the plurality of electronic devices (7) are preferably borne by the road safety barrier (2).

Each support element (4*b*) of the plurality of support elements (4) which comprises a cavity (6) preferably also comprises: an opening (13) for accessing the relative cavity (6) from outside; and a cover (14) for closing the opening (13) which is removably fixable to the support element (4*b*) of the plurality of support elements (4) which comprises a cavity (6).

It is easily possible, through the opening (13), to access the inside of the cavity (6) to inspect the inside of the support element (4*b*) of the plurality of support elements (4). The opening (13) consequently facilitates the operations of replacement or repair of an electronic device (7*a*) of the plurality of electronic devices (7). In the absence of the opening (13), for the operations of replacement or repair of an electronic device (7*a*) of the plurality of electronic devices (7), first the first pair of plates (10) of the first half-shell (9) should be unbolted from the second pair of plates (12) of the second half-shell (11); at this point the re-directing element (3*a*) of the plurality of re-directing elements (3), supported by the support element (4*b*) on which work is being carried out, can be separated and, lastly, access is gained to the electronic device of the plurality of electronic devices (7) housed in the cavity (6) in question: this operation is complex and laborious.

Each support element (4*b*) of the plurality of support elements (4) comprising a cavity (6) is preferably shaped as a pole having a lateral surface at which the opening (13) is afforded; each electronic device (7*a*) of the plurality of electronic devices (7), when housed in the cavity (6), is arranged so as to face the opening (13).

It is possible, through the opening (13), to advantageously access from the outside, directly and easily, the electronic devices (7*a*) of the plurality of electronic devices (7) housed in the cavity (6), so as to inspect the inside of the support element (4*b*) of the plurality of support elements (4). The opening (13) consequently facilitates the operations of replacement or repair of the electronic device (7*a*) of the plurality of electronic devices (7).

Each support element (4*b*) of the plurality of support elements (4) preferably comprises a housing in which each electronic device (7*a*) of the plurality of electronic devices (7) can be housed with the aim of being supported in the cavity (6).

Each electronic device (7*a*) of the plurality of electronic devices (7) which is housed in a cavity (6) of a support element (4*b*) of the plurality of support elements (4) is preferably borne by the relative cover (14) so that the removal of the cover (14) determines the extraction of the electronic device (7*a*) of the plurality of electronic devices (7) from the cavity (6).

In order to carry out the replacement or repair operations of an electronic device (7*a*) of the plurality of electronic devices (7) which is housed in a cavity (6), it is sufficient to remove the cover (14), detach the electric cable of the plurality of electric cables (8) which supply the electronic device (7*a*) to be replaced or repaired, take out the electronic device (7*a*) and newly cover the opening (13) with a new cover (14) provided with a new electronic device or a repaired electronic device.

The cover (14) can comprise an inner wall (15) to which can be fixed the sensor of the plurality of sensors to which the electronic device of the plurality of electronic devices (7) is connected (see FIGS. 6-9).

The cover (14) can comprise an outer wall (15) to which can be fixed the light signalling source (5*a*) of the plurality of light sources (5) to which the electronic device (7*a*) of the plurality of electronic devices (7) is connected (see FIGS. 6-9).

The plurality of sensors and/or light signalling sources (5) can be connected to a control unit (not illustrated).

The electric cables (8*a*) of the plurality of electric cables (8) are preferably borne by the road safety barrier (2) so as to slide along the road safety barrier (2); at least a first part of the cavities (6) of the support elements of the plurality of support elements (4) is dimensioned so as each to receive a reserve of electric cables (16) of the plurality of electric cables (8); the electric cables (8*a*) of the plurality of electric cables (8) are arranged in such a way as to occupy the cavities (6) of the support elements so that, in at least a part of the cavities (6) of the first part of the cavities (6), the electric cables (8*a*) of the plurality of electric cables (8) form at least a reserve of electric cables (16) so that, if a vehicle impacts against the road safety barrier (2), it deforms the road safety barrier (2) so that it forms a bend, the electric cables (8*a*) of the plurality of electric cables (8) can slide along the road safety barrier (2), reducing the at least a reserve of electric cables (16) (see FIG. 5).

In the event of an impact of a vehicle against the road safety barrier (2), notwithstanding the deformation of the road safety barrier (2), the breakage of the portion of electric cable (8*a*) of the plurality of electric cables (8) on which the vehicle is wedged is prevented, as the at least a reserve of electric cables (16) tends to reduce, guaranteeing that the electric cables (8*a*) of the plurality of electric cables (8) can slide along the road safety barrier (2).

The road safety barrier (2) preferably comprises a plurality of containing elements (17) each having an overturned U section and arranged one following another to form a housing (18) having a channel shape; the electric cables (8*a*) of the plurality of electric cables (8) are arranged in the housing (18); each support element (4*b*) of the plurality of support elements (4) is a pole having a cylindrical shape; the containing elements (17*a*) of the plurality of containing elements (17) are arranged above the support elements (4*b*) of the plurality of support elements (4).

Figure 2A:
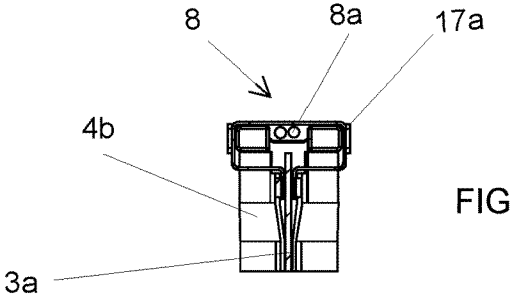
FIG. 2*a* is a section view, along line A-A, of FIG. 2.

Each containing element (17*a*) of the plurality of containing elements (17) can extend longitudinally (see FIG. 2*a*).

The plurality of containing elements (17) advantageously ensures protection of the electric cables (8*a*) of the plurality of electric cables (8) from any impacts of the vehicles against the road safety barrier (2).

Further, as the containing elements (17*a*) of the plurality of containing elements (17) are arranged above the support elements (4*b*) of the plurality of support elements (4), each electric cable (8*a*) of the plurality of electric cables (8) from the housing (18) easily reaches the cavity (6), as it can insert in the cavity (6) once having reached, with a free end, the pole, by effect of the force of gravity.

FIGS. 1, 1*a*, 1*b* and 1*c* illustrate, from left to right: a first impact detecting sensor (19); a half of a first portion of road safety barrier (2) in which the first impact detecting sensor (19) is located; a half of a second portion of road safety barrier (2) in which a second impact detecting sensor (20) is located; and the second impact detecting sensor (20).

The above-mentioned figures of the drawings illustrate only a part of the road safety barrier assembly (1) in which the first impact detecting sensor (19) and the second impact detecting sensor (20) are present. Further, the figures also illustrate a first light signalling source (21), which comprises a first flashing lamp and a second light signalling source (22), which comprises a second flashing lamp (see FIGS. 4 and 5).

Further, the figures also illustrate a further light signalling source (23), which is arranged interposed between the first flashing lamp and the second flashing lamp. The further light signalling source (23) can be a fixed-beam lamp (see FIG. 5).

The invention claimed is:

1. A road safety barrier assembly comprising:

a road safety barrier which extends along the side of a road, in turn comprising:

a plurality of re-directing elements for re-directing a vehicle which impacts against the road safety barrier;

a plurality of support elements for supporting the plurality of re-directing elements;

a plurality of sensors and/or light signalling sources;

wherein at least a part of the support elements of the plurality of support elements each comprises a cavity and are distributed along the road safety barrier;

further comprising:

a plurality of electronic devices which are distributed along the road safety barrier, each of the electronic devices of the plurality of electronic devices being connected to a sensor and/or to a light signalling source of the plurality of sensors and/or light signalling sources and being housed in a cavity of a support element of the plurality of support elements; and a plurality of electric cables which extend along the road safety barrier and which electrically connect each electronic device of the plurality of electronic devices;

wherein each cavity of the support elements of the plurality of support elements is accessible from outside in order to enable replacement or repair of an electronic device of the plurality of electronic devices which is housed internally thereof, wherein each support element of the plurality of support elements which comprises a cavity also comprises: an opening for accessing the relative cavity from outside; and a cover for closing the opening which is removably fixable to the support element of the plurality of support elements which comprises a cavity, and wherein each support element of the plurality of support elements which comprises a cavity has a pole shape having a lateral surface at which the opening is afforded; and each electronic device of the plurality of electronic devices, when housed in the cavity is arranged so as to face the opening.

2. The road safety barrier assembly of claim 1, wherein each electronic device of the plurality of electronic devices which is housed in a cavity of a support element of the plurality of support elements is borne by the relative cover so that the removal of the cover determines extraction of the electronic device of the plurality of electronic devices from the cavity.

3. The road safety barrier assembly of claim 1, wherein:

the electric cables of the plurality of electric cables are borne by the road safety barrier to slide along the road safety barrier;

at least a first part of the cavities of the support elements of the plurality of support elements is dimensioned so as each to receive a reserve of electric cables of the plurality of electric cables; and the electric cables of the plurality of electric cables are arranged in such a way as to occupy the cavities of the support elements so that, in at least a part of the cavities of the first part of the cavities, the electric cables of the plurality of electric cables form at least a reserve of electric cables so that, if a vehicle impacts against the road safety barrier deforms the road safety barrier so that it forms a bend, the electric cables of the plurality of electric cables can slide along the road safety barrier, reducing the at least a reserve of electric cables.

4. The road safety barrier assembly of claim 1, wherein:

the road safety barrier comprises a plurality of containing elements having an overturned U section and arranged one following another to form a housing having a channel shape;

the electric cables of the plurality of electric cables are arranged in the housing;

each support element of the plurality of support elements is a pole having a cylindrical shape; and the containing elements of the plurality of containing elements are arranged above the support elements of the plurality of support elements.

5. A road safety barrier assembly comprising:

a road safety barrier which extends along the side of a road, in turn comprising:

a plurality of re-directing elements for re-directing a vehicle which impacts against the road safety barrier;

a plurality of support elements for supporting the plurality of re-directing elements;

a plurality of sensors and/or light signalling sources;

wherein at least a part of the support elements of the plurality of support elements each comprises a cavity and are distributed along the road safety barrier;

further comprising:

a plurality of electronic devices which are distributed along the road safety barrier, each of the electronic devices of the plurality of electronic devices being connected to a sensor and/or to a light signalling source of the plurality of sensors and/or light signalling sources and being housed in a cavity of a support element of the plurality of support elements;

a plurality of electric cables which extend along the road safety barrier and which electrically connect each electronic device of the plurality of electronic devices;

wherein each cavity of the support elements of the plurality of support elements is accessible from outside in order to enable replacement or repair of an electronic device of the plurality of electronic devices which is housed internally thereof; and wherein the electric cables of the plurality of electric cables are borne by the road safety barrier to slide along the road safety barrier;

at least a first part of the cavities of the support elements of the plurality of support elements is dimensioned so as each to receive a reserve of electric cables of the plurality of electric cables; and the electric cables of the plurality of electric cables are arranged in such a way as to occupy the cavities of the support elements so that, in at least a part of the cavities of the first part of the cavities, the electric cables of the plurality of electric cables form at least a reserve of electric cables so that, if a vehicle impacts against the road safety barrier deforms the road safety barrier so that it forms a bend, the electric cables of the plurality of electric cables can slide along the road safety barrier, reducing the at least a reserve of electric cables.

6. The road safety barrier assembly of claim 5, wherein each support element of the plurality of support elements which comprises a cavity also comprises:

an opening for accessing the relative cavity from outside; and a cover for closing the opening which is removably fixable to the support element of the plurality of support elements which comprises a cavity.

7. The road safety barrier assembly of claim 6, wherein:

each support element of the plurality of support elements which comprises a cavity has a pole shape having a lateral surface at which the opening is afforded; and each electronic device of the plurality of electronic devices, when housed in the cavity is arranged so as to face the opening.

8. The road safety barrier assembly of claim 6, wherein each electronic device of the plurality of electronic devices which is housed in a cavity of a support element of the plurality of support elements is borne by the relative cover so that the removal of the cover determines extraction of the electronic device of the plurality of electronic devices from the cavity.

9. The road safety barrier assembly of claim 5, wherein:

the road safety barrier comprises a plurality of containing elements having an overturned U section and arranged one following another to form a housing having a channel shape;

the electric cables of the plurality of electric cables are arranged in the housing;

each support element of the plurality of support elements is a pole having a cylindrical shape; and the containing elements of the plurality of containing elements are arranged above the support elements of the plurality of support elements.

* * * * *